US006218822B1

(12) United States Patent
MacQuigg

(10) Patent No.: US 6,218,822 B1
(45) **Date of Patent: *Apr. 17, 2001**

(54) CMOS VOLTAGE REFERENCE WITH POST-ASSEMBLY CURVATURE TRIM

(75) Inventor: David R. MacQuigg, Tuscon, AZ (US)

(73) Assignee: National Semiconductor Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/416,897

(22) Filed: Oct. 13, 1999

(51) Int. Cl.[7] ..... G05F 3/16; G05F 3/20
(52) U.S. Cl. ..... 323/313; 323/316; 323/907
(58) Field of Search ..... 323/313, 314, 323/315, 316, 907

(56) References Cited

U.S. PATENT DOCUMENTS

| | | | | |
|---|---|---|---|---|
| 3,887,863 | | 6/1975 | Brokaw | 323/19 |
| 3,904,976 | * | 9/1975 | Ahmed | 330/257 |
| 3,956,645 | * | 5/1976 | Boer | 327/322 |
| 4,190,805 | | 2/1980 | Bingham | 330/9 |
| 4,250,445 | | 2/1981 | Brokaw | 323/313 |
| 4,327,320 | * | 4/1982 | Oguey | 323/313 |
| 4,543,522 | | 9/1985 | Morean | 323/303 |
| 4,546,307 | * | 10/1985 | Llewellyn | 323/315 |
| 4,603,291 | | 7/1986 | Nelson | 323/315 |
| 4,613,809 | | 9/1986 | Skovmand | 323/268 |

(List continued on next page.)

OTHER PUBLICATIONS

B. Song and P.R. Gray, "A Precision Curvature–Compensated CMOS Bandgap Reference," *JSSC*, pp. 634–643, Dec. 1983.

Holman, Timothy, "A New Temperature Compensation Technique for Bandgap Voltage References," *ISCAS*, pp. 385–388, 1996, No Month.

Rincon–Mora, G.A. and Allen, P.E., A1.1V Current _Mode and Piecewise–Linear Curvature–Corrected Bandgap Reference, *JSSC*, pp. 1551–1554, Month 1998.

Gray, P.R. and Meyer, R.G., "Band–Gap Referenced Biasing Circuits," *section A4.3.2 in Analysis and Design of Analog Integrated Circuits*, 3rd ed. no date.

Sze, S.M., "Carrier Transport Phenomena," *section 1.5 in Physics of Semiconductor Devices*, 2nd ed. (Wiley, 1981). no month.

Annema, Anne–Johan, "Low–Power Bandgap References Featuring DTMOST's," *IEEE Journal of Solid–State Circuits*, vol. 34, No. 7, pp. 949–955, Jul. 1999.

Banba, Hironori et al., "A CMOS Bandgap Reference Circuit with Sub–1–V Operation," *IEEE Journal of Solid–State Circuits*, vol. 34, No. 5, pp. 670–673, May 1999.

(List continued on next page.)

*Primary Examiner*—Peter S. Wong
*Assistant Examiner*—Bao Q. Vu
(74) *Attorney, Agent, or Firm*—Beyer Weaver & Thomas, LLP

(57) ABSTRACT

An apparatus and method for performing curvature trim in a voltage reference circuit that allows a curvature error to be trimmed after the circuit has been packaged. The curvature trim may be performed by switching in segments of one or more non-linear resistors, such as n-type lightly doped drain (LDD) diffused resistors, having a curvature characteristic that is opposite to the normal band-gap curvature. Specifically, a network of non-linear resistors may be selected via selection bits stored in a non-volatile memory. Since various combinations of the resistors may be selected by programming the memory, the curvature of a band-gap reference can be adjusted after final packaging. This curvature correction method achieves a reliable and accurate correction for the curvature variations associated with various process changes.

26 Claims, 9 Drawing Sheets

U.S. PATENT DOCUMENTS

| | | | | |
|---|---|---|---|---|
| 4,792,747 | | 12/1988 | Schroeder | 323/303 |
| 4,803,612 | | 2/1989 | Skovmand | 323/284 |
| 4,808,908 | | 2/1989 | Lewis et al. | 323/313 |
| 4,902,959 | | 2/1990 | Brokaw | 323/314 |
| 4,906,913 | | 3/1990 | Stanojevic | 323/303 |
| 4,926,109 | | 5/1990 | Koterasawa | 323/274 |
| 4,928,056 | | 5/1990 | Pease | 323/314 |
| 5,070,295 | * | 12/1991 | Morigami | 323/314 |
| 5,126,653 | | 6/1992 | Ganesan et al. | 323/313 |
| 5,168,209 | | 12/1992 | Thiel | 323/313 |
| 5,191,278 | | 3/1993 | Carpenter | 323/275 |
| 5,274,323 | | 12/1993 | Dobkin et al. | 323/280 |
| 5,291,122 | | 3/1994 | Audy | 323/323 |
| 5,325,045 | | 6/1994 | Sundby | 323/313 |
| 5,334,928 | | 8/1994 | Dobkin et al. | 323/280 |
| 5,352,973 | | 10/1994 | Audy | 323/313 |
| 5,391,980 | | 2/1995 | Thiel et al. | 323/314 |
| 5,410,241 | | 4/1995 | Cecil | 323/315 |
| 5,422,563 | * | 6/1995 | Pflueger | 323/313 |
| 5,485,109 | | 1/1996 | Dobkin et al. | 327/77 |
| 5,510,697 | | 4/1996 | Dormer | 323/273 |
| 5,519,308 | | 5/1996 | Gilbert | 323/313 |
| 5,563,504 | | 10/1996 | Gilbert et al. | 323/316 |
| 5,610,505 | * | 3/1997 | Bernardson et al. | 323/315 |
| 5,629,609 | | 5/1997 | Nguyen et al. | 323/269 |
| 5,631,598 | | 5/1997 | Miranda et al. | 327/540 |
| 5,672,959 | | 9/1997 | Der | 323/273 |
| 5,675,241 | | 10/1997 | Teggatz et al. | 323/282 |
| 5,677,558 | | 10/1997 | McGlinchey | 257/370 |
| 5,686,821 | | 11/1997 | Brokaw | 323/273 |
| 5,705,919 | | 1/1998 | Wilcox | 323/282 |
| 5,736,843 | | 4/1998 | Amin | 323/273 |
| 5,814,979 | | 9/1998 | Grimm | 323/284 |
| 5,867,015 | | 2/1999 | Corsi et al. | 323/316 |
| 5,917,311 | * | 6/1999 | Brokaw | 323/316 |

OTHER PUBLICATIONS

Sudha, Maramreddy and Holman, W. Timothy, "A Low Noise Sub–Bandgap Voltage Reference," *IEEE*, pp. 193–196, 1997, no month.

Pease, Robert A., "The Design of Band–Gap Reference Circuits: Trials and Tribulations," *IEEE 1990 Bipolar Circuits and Technology Meeting 9.3*, pp. 214–218. 1990 no month.

Lin, S.L. and C.A.T Salama, "Regular Correspondence," *IEEE Journal of Solid–State Circuits*, vol. SC–20, No. 6, pp. 1283–1285, Dec. 1985.

Michejda, John and Kim, Suk. K., "A Precision CMOS Bandgap Reference," *IEEE Journal of Solid–State Circuits*, vol. SC–19, No. 6, pp. 1014–1021, Dec. 1984.

Palmer, Carl R. and Dobkin, Robert C., "A Curvature Corrected Micropower Voltage Reference," *Session VI: Data Acquisition Circuits, ISSCC 81*, pp. 58–59, Feb. 18, 1981.

Frederiksen, Thomas M., "Intuitive IC OP Amps," From-BAsics to Useful Applications, *National's Semiconductor Technology Series*, pp. 8–12, 1984. no month.

"IC Preamplifier Challenges Choppers on Drift," *National Semiconductor*, Application Notes 79–81, pp. 279–281. no date.

* cited by examiner

CM OS VOLTAGE REFERENCE WITH POST-ASSEMBLY CURVATURE TRIM

The present invention is related to U.S. patent application Ser. No. 09/416,899, entitled "CMOS VOLTAGE REFERENCE WITH A NULLING AMPLIFIER" filed Oct. 13, 1999; U.S. patent application Ser. No. 09/416,896, entitled "SLOPE AND LEVEL TRIM DAC FOR VOLTAGE REFERENCE" filed Oct. 13, 1999; and U.S. patent application Ser. No. 09/416,898, entitled "LOW DROPOUT VOLTAGE REFERENCE" filed Oct. 13, 1999; all applications are commonly assigned to the assignee of the present invention, and the disclosures of which are herein incorporated by reference.

BACKGROUND OF THE INVENTION

1. Field of the Invention

The present invention relates generally to the field of CMOS voltage references, and more particularly to an apparatus and method for providing post-assembly curvature trim.

2. Description of the Related Art

Using a CMOS process to make a voltage reference has cost advantages over a precision-trimmed bipolar process. Problems with the accuracy and stability of CMOS devices must be overcome, however, in order to make a CMOS reference competitive in performance with bipolar references. Specifically, the lack of high-value stable and trimmable resistors presents a problem for circuit designers.

In order to adjust for variances in each circuit, voltage references are "trimmed" after manufacture in order to bring the output values within a specified range. This is generally accomplished by using lasers to etch away certain thin-film resistors (thereby increasing the resistance by decreasing the cross-sectional area). With proper design, most devices can be brought within the specified range using this technique. However, once the device (i.e. silicon die) is placed into a package, the mechanical stresses caused by the packaging can once again cause the circuit parameters to vary. Therefore, a competitive CMOS voltage reference must be designed such that the circuit may be "trimmed" after the final assembly of the die into a package.

One aspect of a voltage reference design requiring special consideration is "curvature correction." Curvature correction has been the subject of many papers and patents over the past two decades. One of the earliest circuits is disclosed in U.S. Pat. No. 4,250,445 entitled "BAND-GAP VOLTAGE REFERENCE WITH CURVATURE CORRECTION" by Brokaw. As shown in FIG. 1, the disclosed circuit uses a diffused resistor Rb to add a low-order (temperature squared or $T^2$) correction term to the reference output. The $T^2$ term is generated not by the resistor Rb itself (which is assumed to be linear) but by the combination of a positive temperature coefficient (TC) in the resistor Rb and the positive TC in the current forced through the resistor. The operation of the band-gap cell forces the current in all resistors to be "proportional to absolute temperature" (PTAT). As long as Rb has a TC more positive that the other resistors in the circuit, the voltage across the resistor will have a $T^2$ term. Thus, the Brokaw curvature correction technique is only a second order ($T^2$) correction, whereas real band-gap circuits have a significant amount of higher order curvature. Also, there is no mechanism to easily trim the curvature, once the device is packaged.

Efforts to improve on the Brokaw technique have generally used sophisticated circuits to generate higher order correction terms, often attempting to match the theoretical "TlnT" characteristic of an "ideal" band-gap reference. Two such techniques are disclosed in U.S. Pat. No. 5,352,973 entitled "TEMPERATURE COMPENSATION BANDGAP VOLTAGE REFERENCE AND METHOD" and U.S. Pat. No. 5,519,308 entitled "ZERO-CURVATURE BANDGAP REFERENCE CELL." These circuits generally require components not available in a low-cost CMOS process, however. Also, as discussed below, real voltage references deviate significantly from the ideal "TlnT" characteristic.

Thus, it would be desirable to have an improved curvature trim technique, suitable for use with CMOS voltage references and providing post-assembly trim.

SUMMARY OF THE INVENTION

The present invention is an apparatus and method for performing curvature trim in a voltage reference circuit that allows a curvature error to be trimmed even after the circuit has been packaged. In one embodiment, the curvature trim is performed by connecting one or more non-linear resistors, such as diffused lightly-doped drain (LDD) resistors, to a band-gap reference. The curvature characteristics of the non-linear resistor is such that the negative curvature error associated with a band-gap reference is cancelled. In fact, this curvature correction is better than that of an ideal "TlnT" corrector. In another embodiment, a set of series non-linear resistors may be selected via selection bits stored in an EEPROM (or other similar non-volatile memory). Since various combinations of the resistors may be selected by programming the EEPROM, the curvature of a band-gap reference can be adjusted after final packaging. This curvature correction method achieves a reliable and accurate correction for the curvature variations that occur with process changes.

In yet another alternative embodiment, one or more resistors associated with the band-gap core may be formed using non-linear resistors, such as diffused LDD resistors. As in the other embodiments, the curvature of the diffused resistors compensates for the normal band-gap curvature, and combinations of resistors may be selected via a programmable non-volatile memory, even after the circuit has been packaged.

Once the voltage reference is packaged, the voltage reference may be calibrated by programming the non-volatile memory. Thus, the present invention provides an improved curvature trim technique, suitable for use with CMOS voltage references and providing post-assembly trim.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide an apparatus and method for providing post-assembly curvature trim.

Figure 2:
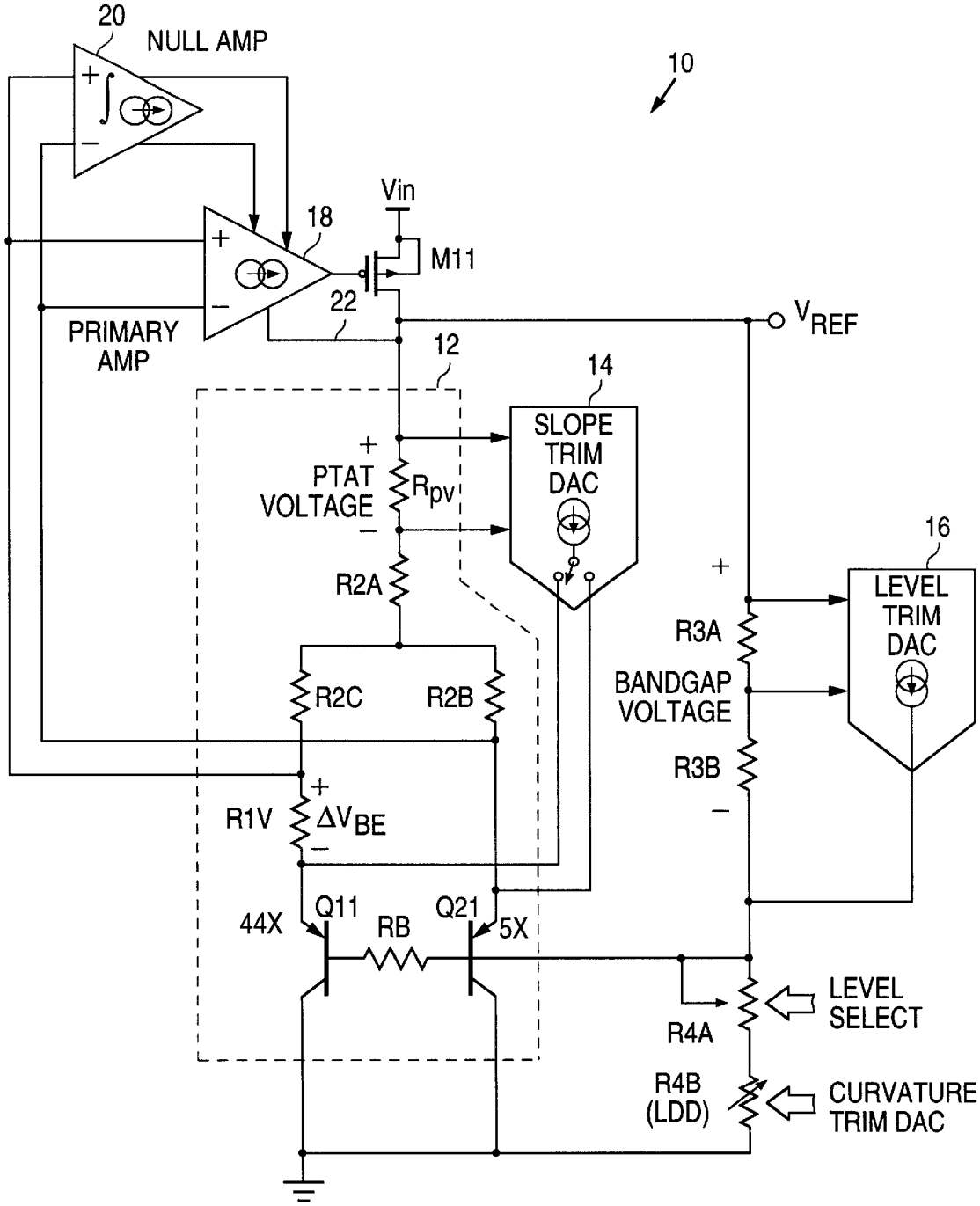
FIG. 2 is a block diagram of a CMOS voltage reference incorporating the present invention.

A CMOS voltage reference 10 incorporating the present invention is shown in FIG. 2. The voltage reference comprises a band-gap core 12, connected to a primary amplifier 18, an output FET M11, and a null amplifier 20. The circuit further comprises a slope trim DAC 14 and a level trim DAC 16 for adjusting the slope and level of the output $V_{REF}$. A level select R4A selects one of the available output voltage options, for example, the circuit can be designed to output three different $V_{REF}$ values. Finally, the curvature trim DAC R4B is shown as a potentiometer to illustrate that it has a variable resistance, but as described below, it actually consists of a network of non-linear resistors that can be controlled by setting a non-volatile memory. In fact, the slope, level and curvature trims can be performed after final packaging via the non-volatile memory. The CMOS voltage reference of FIG. 2 provides a precision voltage reference that can be manufactured in a standard CMOS process and trimmed after final assembly.

According to the present invention, curvature trim may be performed by switching in segments of a non-linear resistor, such as an n-type lightly doped drain (LDD) diffused resistor, having a curvature characteristic that is opposite to the normal band-gap curvature. Specifically, in FIG. 2, R4B is a set of series LDD resistors, which may be selected via selection bits stored in an EEPROM (or other similar non-volatile memory, not shown). Polysilicon fuses may also be used to select the appropriate combination of resistors. Since various combinations of the resistors may be selected by programming the EEPROM, (or burning the fuses) the curvature of a band-gap reference can be adjusted after final packaging. This curvature correction method achieves a reliable and accurate correction for the curvature variations of a low-cost CMOS voltage reference.

Figure 3:
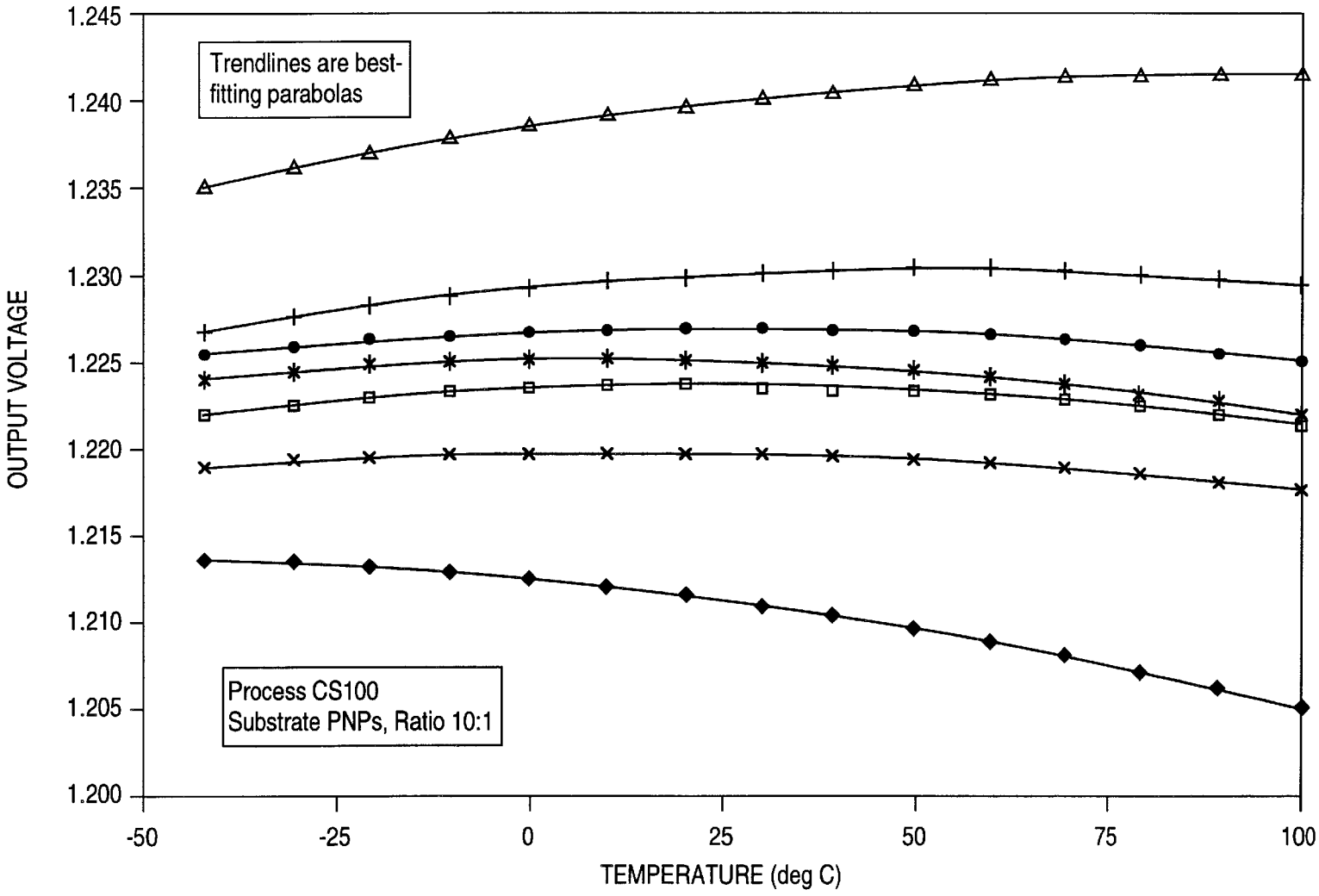
FIG. 3 is a graph of output voltage vs. temperature for actual data from band-gap cores.

In FIG. 3, plots of the actual output characteristics for several untrimmed voltage references (units) are shown. These measurements were taken on "core-cell" circuits similar to that of FIG. 2, but without the level and slope trim, or any curvature correction (R4A=R4B=0). As shown in FIG. 3, the major variation appears to be a "pivoting" of the curves about T=−273 (absolute zero). These variations come primarily from mismatches in the core-cell transistors Q11, Q21 and offsets in the primary amplifier. Also, there is a downward or "negative" curvature in each of these units. This curvature comes partly from the inherent behavior of the bipolar transistors and partly from "aberrations"—or non-fundamental deviations in the behavior of real circuits, compared to the theoretical ideal. Some of these aberrations are predictable, at least experimentally, by making measurements on a particular process, but some are erratic, and cannot be corrected no matter how sophisticated the correction circuit. An example would be hysteresis, i.e. the variation in repeated measurements at the same temperature due to prior changes in temperature.

From the experimental data on the CMOS process used (a low-cost, 0.72 μm, CMOS process) it can be observed that corrections beyond the third-order are futile. The aberrations are such that no further reduction in error is achievable with higher order corrections. In fact, the ideal theoretical "T ln(T)" correction model is not as good as the present third-order curvature correction solution. The "skew" in the curvature is actually larger than theory predicts, and the present invention accommodates that extra skew. It can also be shown that the residual errors, after trimming out third-order curvature, are much smaller than other factors that limit the accuracy of commercial CMOS voltage references.

The following background discussion of band-gap theory is presented, in order to explain the operation of the present curvature correction technique. As shown in FIG. 2, a band-gap core comprises a pair of bipolar transistors Q11, Q21 which generate a voltage proportional to absolute temperature (PTAT). A network of resistors connected to these transistors Q11, Q21 are arranged to multiply the PTAT voltage and add it to the base-emitter of one of the transistors so that the total voltage is constant over temperature. A more thorough derivation is presented in Gray & Meyer, *Analysis and Design of Analog Integrated Circuits,* "Band-Gap-Referenced Biasing Circuits," section A4.3.2,3rd ed. (Wiley, 1993), the standard textbook in this field. In U.S. Pat. No. 5,519,308 (Gilbert), the textbook equations are presented in a more readable form, which is what is presented here.

The base-emitter voltage of a bipolar transistor can be written as $$V_{BE}(T)=V_T ln(I_C/A_J J_S(T)) \tag{1}$$

where $$V_T=kT/q \text{ thermal voltage} \tag{2}$$

$$\text{and} \begin{cases} I_C = \text{collector current} \\ A_J = \text{area of emitter junction} \\ J_s = \text{emitter current density} \end{cases}$$

The temperature-dependent factors in this equation can be further expanded as $$J_s=qn_i^2 T\mu/Q_B \tag{3}$$

$$n_i^2(T)=c_1 T^3 \exp(-V_{G0}/V_T) \text{ intrinsic carrier density} \tag{4}$$

$$\mu(T)=c_2 T^{-n} \text{ base carrier mobility} \tag{5}$$

where $V_{G0}$ is the band-gap voltage, extrapolated to 0° K, and the other constants are independent of temperature and will cancel out in the final formula.

Combining these equations, and lumping all the constants into $c_3$, gives an explicit function of T $$V_{BE}(T)=V_{G0}+V_T ln(I_c T^{-\gamma} c_3) \tag{6}$$

where $$\gamma=4-n \text{ temperature exponent of current density} \quad (7)$$

Equation 6 can be put in a more useful form by defining a reference temperature $T_R$, typically 25° C., and a temperature factor H.

$$V_{BE}(T) = V_{G0} - H(V_{G0} - V_{BER}) + HV_{TR}\ln\left[\left(\frac{I_C}{I_{CR}}\right)H^{-\gamma}\right] \quad (8)$$

$$\text{Where} \begin{cases} H = T/T_R & T \text{ in degrees Kelvin} \\ V_{BER} = V_{BE}(T_R) \\ V_{TR} = kT_R/q \\ I_{CR} = I_C(T_R) \end{cases} \quad (9)$$

Further simplification can be made if we assume $I_C$ can be modeled as a simple exponential. Then $$I_C/I_{CR}=H^{\alpha} \quad (10)$$

$$V_{BE}(T)=V_{G0}-H(V_{G0}-V_{BER})-(\gamma-\alpha)V_{TR}H\ln(H) \quad (11)$$

The band-gap circuit is designed to add to this $V_{BE}$ a PTAT voltage $$V_{REF}(T)=V_{BE}(H)+KH \quad (12)$$

Adjusting the constant K to give zero slope at H=1, gives the final result $$K=(V_{G0}-V_{BER})+(\gamma-\alpha)V_{TR} \quad (13)$$

$$V_{REF}(H)=V_{G0}+(\gamma-\alpha)V_{TR}H(1-\ln H) \quad (14)$$

Typical values are $V_{G0}$=1.205,$\gamma$=3.2, and $\alpha$=1 (from Gray & Meyer). With these values and $V_{TR}$=25.7mV at 298° K, $$V_{REF}(T)=1.205+0.0565H(1-\ln H)=1.262 \text{ at } H=1 \quad (15)$$

Figure 1:
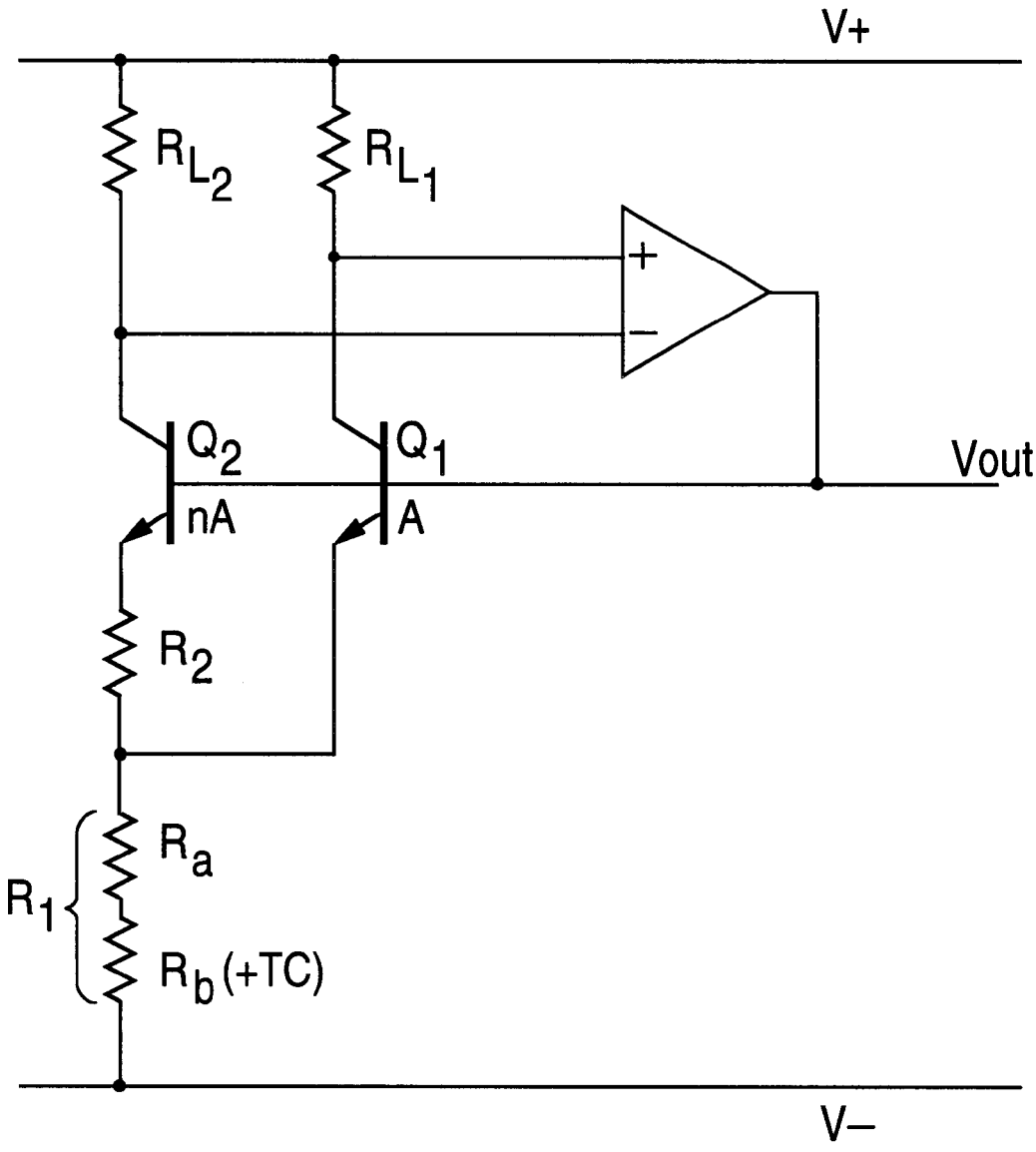
FIG. 1 (PRIOR ART)
FIG. 1 is a schematic diagram of a prior art band-gap reference incorporating curvature correction.

From these equations, the following observations and conclusions can be made. The entire temperature dependence of equation 14 is contained in the simple function H(1−lnH), where H is the absolute temperature, normalized to the reference temperature 25° C. This function has a maximum value 1 at H=1, and drops 3% on either side over the range −44 to +102° C. This slight asymmetry compared to a parabola has been the focus of much effort over the last twenty years as designers try to improve on the simple parabolic correction developed by Brokaw, as shown in FIG. 1.

The accuracy of the TlnT theory depends on assumptions that the constants $V_{G0}$, $\gamma$ and $\alpha$, do not vary with temperature. This is clearly not true for real transistors. The constant $\gamma$, for example, which represents the temperature exponent of collector current, includes the temperature exponent of mobility, which can vary from −2.42 in lightly-doped n-type silicon at high temperature, to +0.6 heavily-doped p-type silicon at low temperature. According to equation 16, a variation of 0.1 in this parameter causes a variation of 2.6 mV in the reference voltage. Given this variation, it is rather amazing that band-gaps can be trimmed to better than 1 mV. The temperature variation of $\gamma$ is larger for the more heavily-doped materials, which leads to the expectation that real band-gap circuits will become ever more deviant from the ideal as the industry moves to CMOS processes designed for ever smaller digital circuits.

Figure 4:
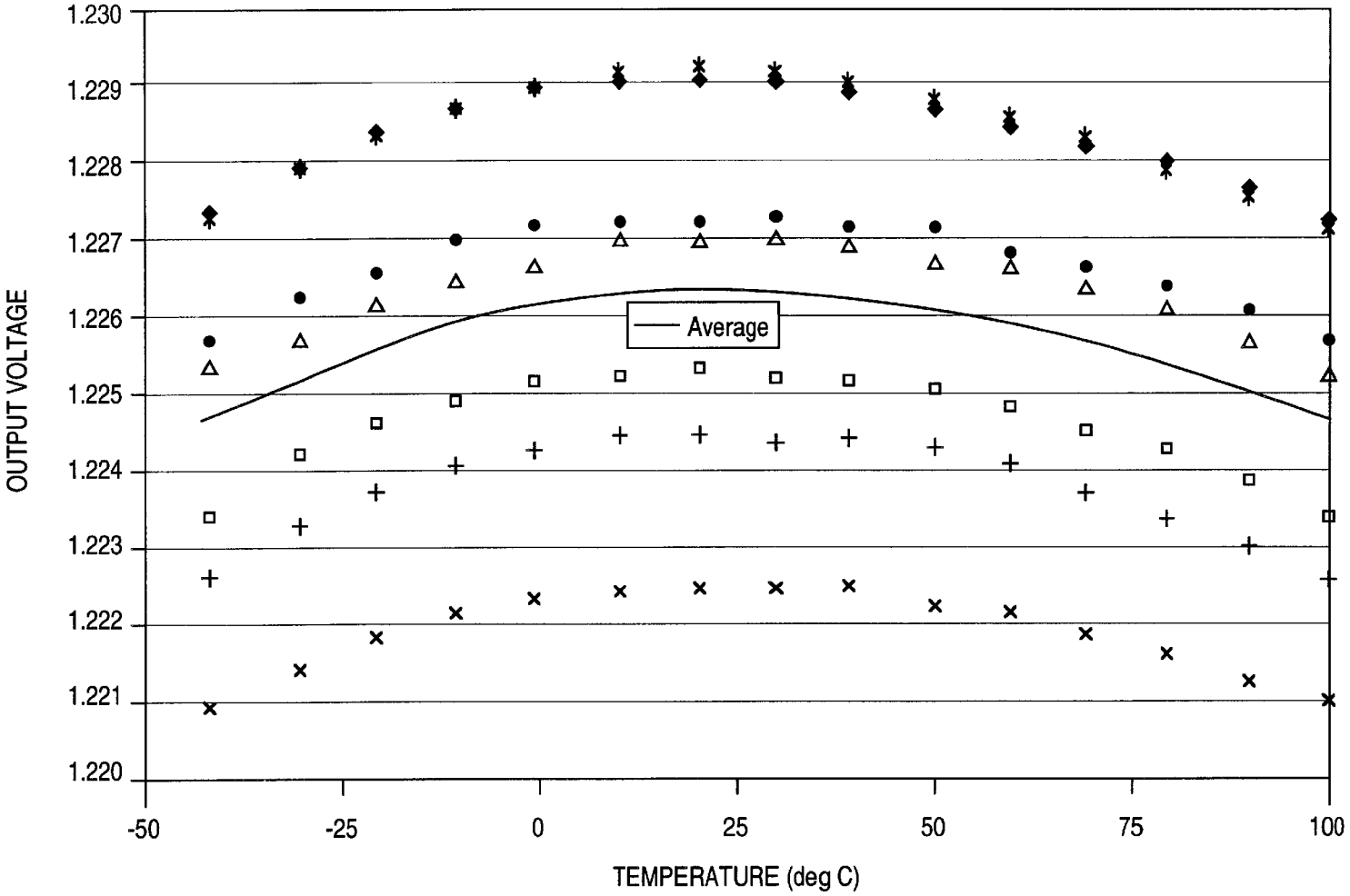
FIG. 4 is a graph of the data of FIG. 3, after the slope has been trimmed.

In order to further evaluate the real data shown in FIG. 3, the slope error is trimmed by adjusting the slope-trim DAC in FIG. 2 for each voltage reference. The slope and level trim may be performed as disclosed in related U.S. patent application Ser. No. 09/416,896, entitled "SLOPE AND LEVEL TRIM DAC FOR VOLTAGE REFERENCE" filed Oct. 13, 1999. The teachings of the present invention, however, may be applied to voltage reference circuits using any slope and level trim techniques known to those skilled in the art. As a result of the slope trim, a much tighter curve distribution is produced as shown in FIG. 4. The spread at room temperature has now been reduced from 30 mV (3%) to 7 mV (0.6%). What remains is the variation in the so-called "magic voltage" (the voltage which makes the reference "flat" at room temperature). It is clear that this variation cannot be accounted for by variations in $\gamma$ or $\alpha$. These constants affect the curvature, which appears to be fairly uniform in FIG. 4.

Figure 5:
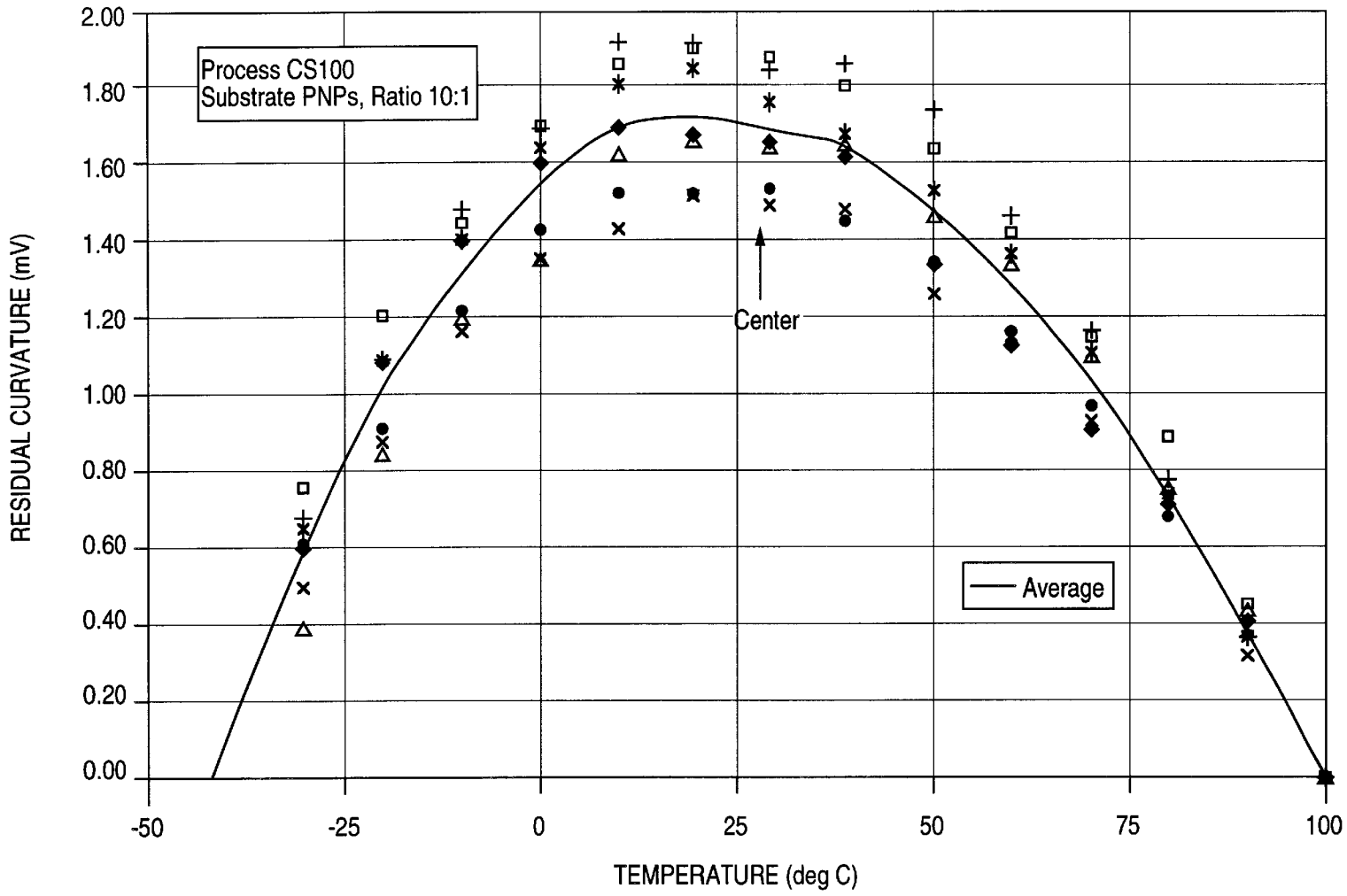
FIG. 5 is a graph of the data of FIG. 3, after both the slope and level have been trimmed.

After trimming out the level variations of the curves in FIG. 4, a residual curvature remains as shown in FIG. 5. From FIG. 5, the following observations can be made:

1. The curvature is nearly parabolic, with the major variation being the height of the parabola (1.5 mV to 1.9 mV for this process).
2. The parabola has a little "skew" to the left, suggesting that there might be some benefit to including a small amount of third-order correction.
3. There are some "dents" in the curves, representing aberrations on the order of 50 $\mu$V that may be impossible to correct.

Figure 6:
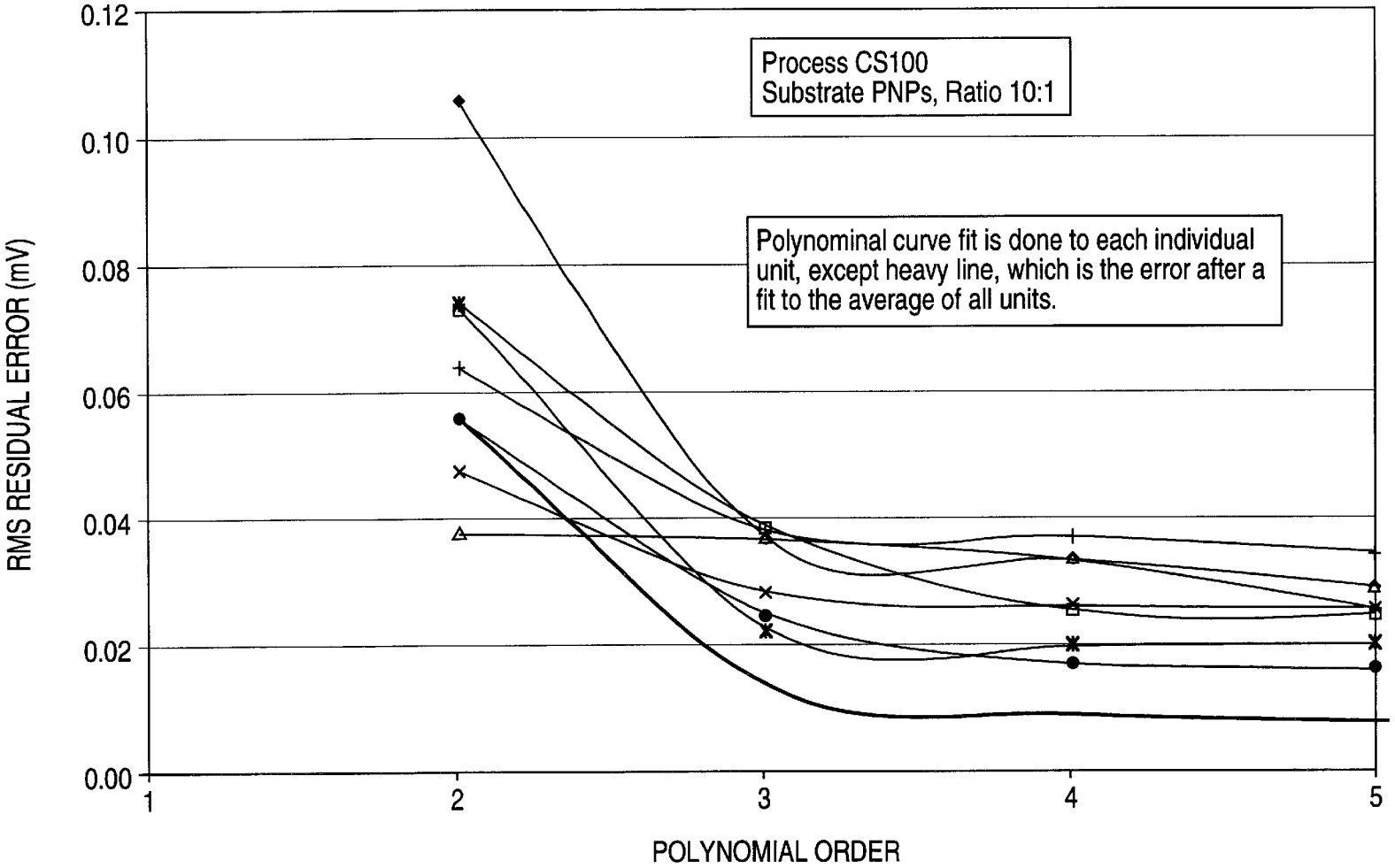
FIG. 6 is a graph of the residual error vs. polynomial order, in other words, the root-mean-square deviation of the data points from a best fitting polynomial.

Next, an optimum polynomial to fit each voltage reference was determined, and a residual error as a function of the polynomial order was computed. The results in FIG. 6 show that there is some benefit for most references in adding a small amount of third-order correction, but any higher-order corrections make no difference. The minimum error is 20 to 40 $\mu$V, and this minimum is achieved with a third-order correction.

The errors shown in FIG. 6 are much smaller than other factors that limit the precision of commercial voltage references. A 1.25 V reference that must meet a specification of 10 ppm/° C., for example, can have a 2 mV variation over a 150° C. range. So, as a practical matter, there is no need to waste trim bits on the third-order coefficient in a real curvature corrector. According to the present invention, the circuit trims the second-order coefficient, but just uses a fixed value for the third-order coefficient.

Figure 7:
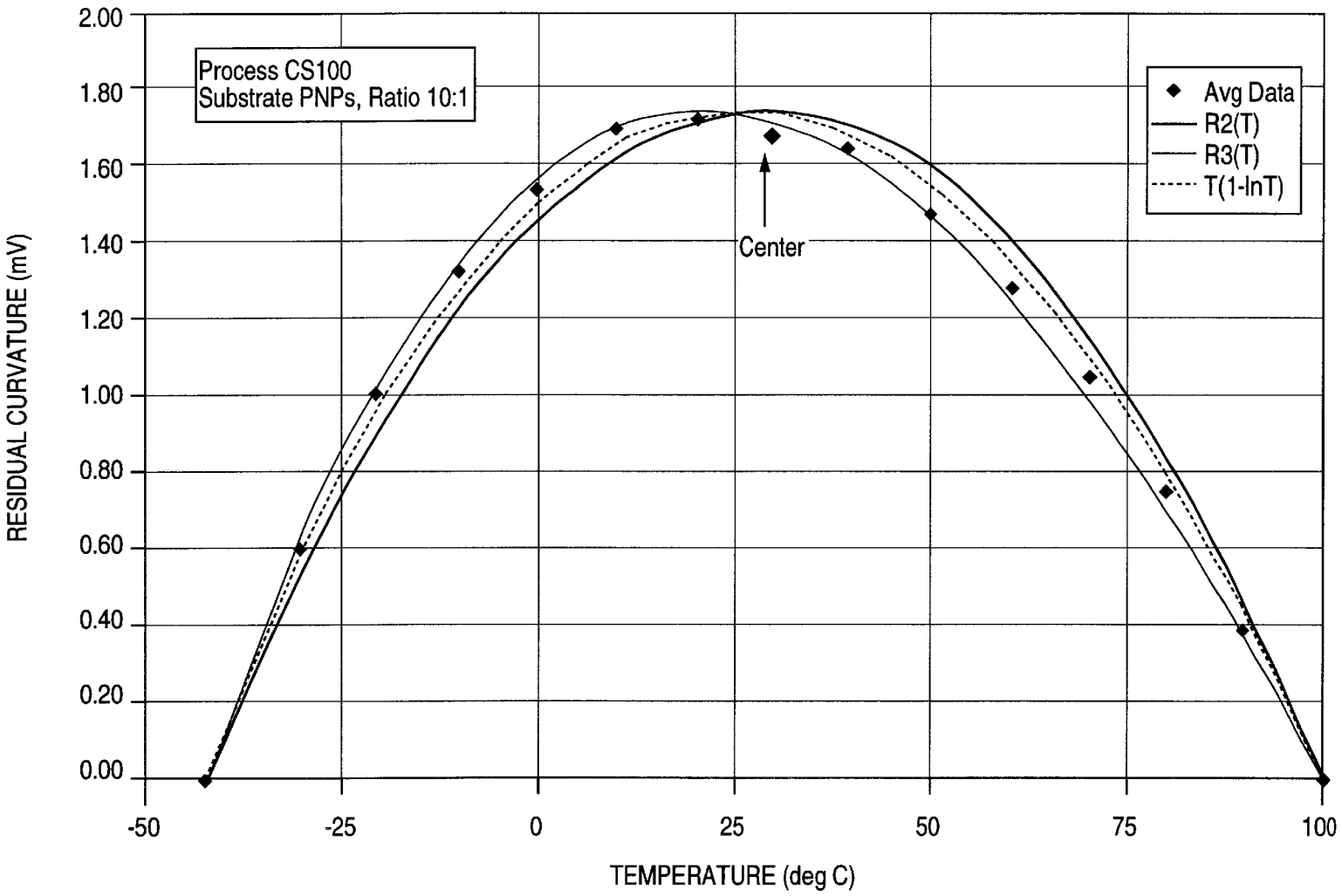
FIG. 7 is a graph of various curvature correction schemes and the average of the experimental data.

FIG. 7 shows the final result of various trim methods on the experimental data. The diamonds show the average of experimental data for seven voltage references. The R2(T) curve is a parabolic correction, and the R3(T) curve shows a correction using a diffused resistor made from the same implant as used for the "lightly-doped drain" (LDD) extensions of NMOS transistors in certain CMOS processes. Measurements on eight of these LDD resistors produce the following characteristics:

$$R(T)=R_0*(1+C_{T1}\Delta T+C_{T2}\Delta T^2+C_{T3}\Delta T^3) \quad (16)$$

$$\text{where} \begin{cases} \Delta T = T - 25^\circ \text{ C.} \\ C_{T1} = 7.20E-4 \\ C_{T2} = 1.28E-5 \\ C_{T3} = -3.77E-8 \end{cases} \quad (17)$$

Figure 8:
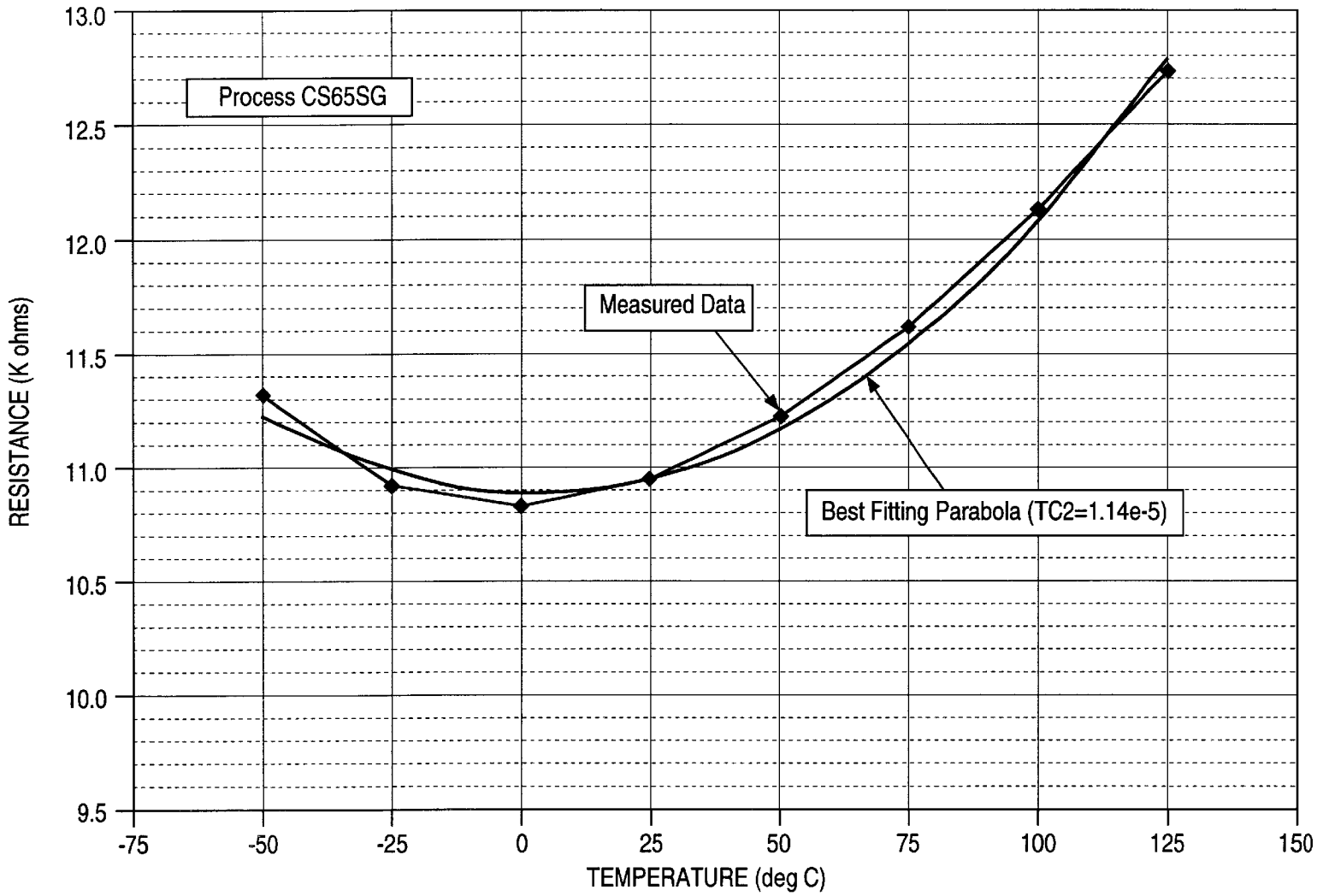
FIG. 8 is a graph of the resistance vs. temperature for an n-type lightly-doped drain (LDD) resistor according to the present invention.

As shown in FIG. 8, an LDD-type resistor has a "positive" curvature characteristic. When this resistor is added to the circuit of FIG. 2 as R4B, the positive curvature generated by $C_{T2}$ will cancel the negative curvature of the core cell. By trimming the value of this resistor R4B, the total second-order curvature can be adjusted to zero. For example, assuming 10 $\mu$A flows through resistors R3B and R4A, and R4B is trimmed to 2.43 K, the correction will be $$\Delta V=24.3mV*(1+C_{T1}\Delta T+C_{T2}\Delta T^2+C_{T3}\Delta T^3) \quad (18)$$

Figure 9:
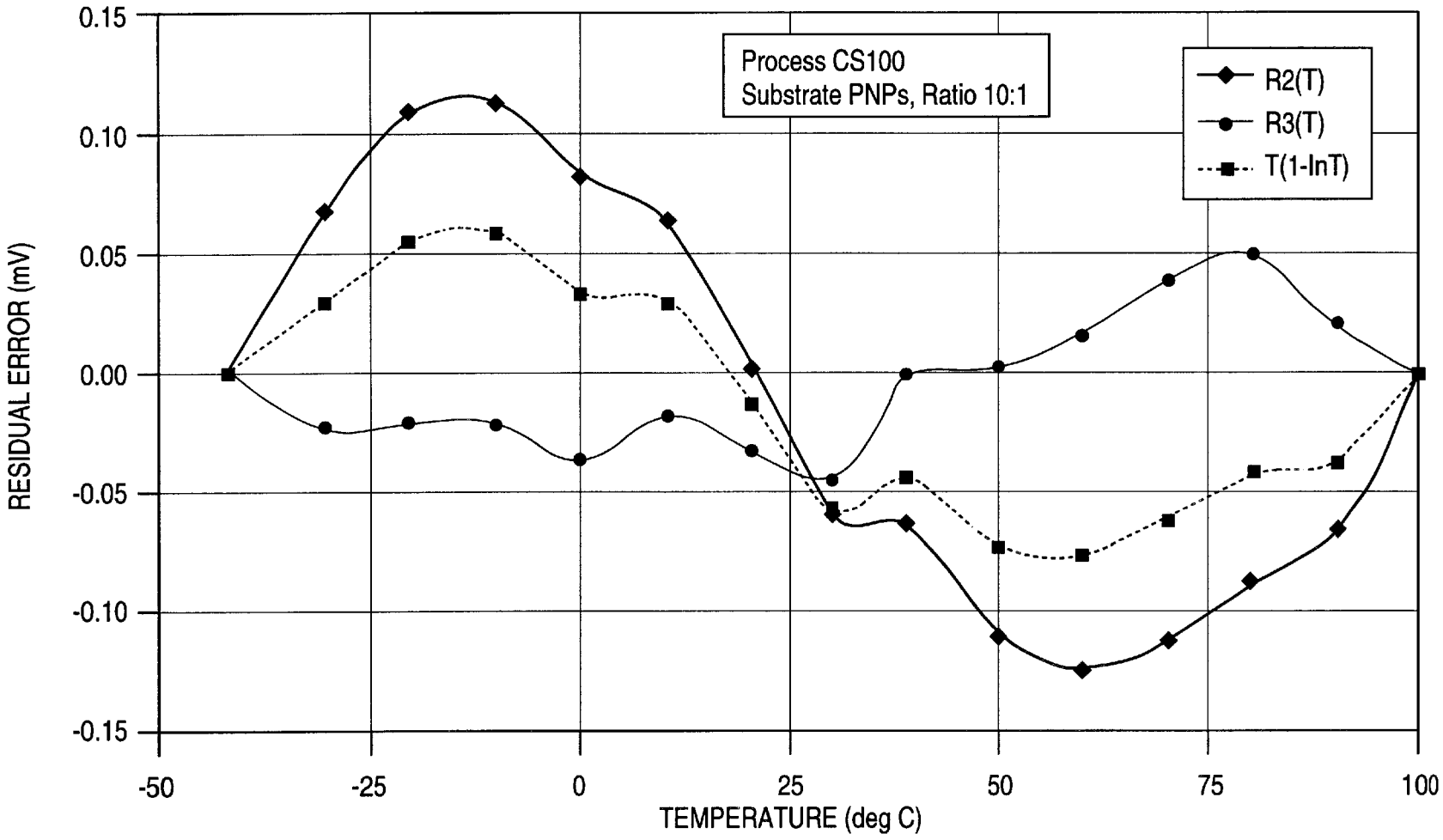
FIG. 9 is a graph of the data of FIG. 7, showing the differences between the experimental data and various correction curves.

Taking out an equal amount of resistance from R4A offsets the constant term. The difference between the slope term and the resistance removed from R4A is taken out by the slope-trim DAC. The curvature term generates a lift of 1.75 mV at −50 and +100° C., just what is needed to offset the curvature of FIG. 5. In fact, the third-order term generates a small amount of "skew" which nearly matches the skew of FIG. 5. FIG. 9 shows the averaged data of FIG. 7 after application of various curvature correction techniques. R2(T) is an ideal parabolic corrector, R3(T) is the third-order correction generated by the non-linear resistor network of the present invention. The T(1−lnT) curve is the theoretical ideal correction curve. Notice that the R3(T) provides a better correction than the "ideal" curve.

Since R4B must be trimmed to adjust $C_{T2}$, the skew correction is, in effect, determined by the ratio $C_{T3}/C_{T2}$. From FIG. 7, this correction appears to be just a little more than needed to fit the data, but it actually gives a better fit than the ideal TlnT corrector. In other words, the present invention provides a better curvature correction for real circuits, than a theoretical "ideal" corrector. If even better correction is ever needed, or if a given CMOS process does not provide LDD resistors with an appropriate amount of skew, the ratio $C_{T3}/C_{T2}$ can be modified by making a network with small sections of other resistors. The n+ resistor in a standard CMOS process, for example, has a strong negative curvature and a different ratio $C_{T3}/C_{T2}$.

The curvature-trim DAC must adjust for both the variations seen in FIG. 5 (+/−10%), and the variations due to ratio error between the diffused resistor R4B and the other resistors R3A, R3B and R4A, which are polysilicon. This ratio error can be as large as +/−20% in a current CMOS process. A 4-bit curvature DAC covering a range of +/−30% should allow adjustment to within +/−2% (or +/−40 $\mu$V) which is near the minimum residual error shown in FIG. 5. Trimming only the resistor ratio error, a procedure requiring no temperature cycling, will reduce the error to just +/−200 $\mu$V, which is good enough for most commercial references.

In the Brokaw solution, a diffused resistor Rb is used, but it is assumed that the resistor is linear with temperature and has a positive TC. The current through the cell also has a positive TC, and the current times the resistance gives a quadratic coefficient that is used to compensate for the curvature. The Brokaw circuit, however, does not use the curvature of the resistor itself to provide the curvature correction. In contrast, the present invention relies entirely on the quadratic and higher order terms in the resistor R4B itself, and assumes the current is constant, since $V_{REF}$ is constant. Resistor R4B has a non-linear temperature characteristic chosen to match the second and third-order curvature of the band-gap core. The embodiments disclosed herein use LDD-type resistors, but any network of non-linear resistors having similar temperature curvature can be used without departing from the scope of the present invention.

In one implementation of the present invention, a voltage reference as shown in FIG. 2 can be constructed for producing three different voltage options: 2.048 V, 2.5 V and 4.096 V. The desired output voltage $V_{REF}$ is selected by switching in one of three resistors used to form the level-select R4A. In order to provide the necessary curvature correction for each of these voltage options, R4A contains some additional segments of LDD resistance. R4B consists of a series of 16 LDD resistors controlled by a four-bit code. The curvature-trim DAC, together with the level-select bits, thus select an appropriate combination of resistors, in order to adjust the curvature.

For example, the following typical resistor values are used for each output voltage range:

$V_{REF}$=2.048 V 0K+6.4K+[N×800]Ω

$V_{REF}$=2.5 V 2.8K+6.4K+[N×800]Ω

$V_{REF}$=4.096 V 13K+6.4K+[n×800]Ω where n is selected to provide the appropriate trim for each different voltage range, and each voltage reference during calibration. The values of "n" are stored in an EEPROM after final packaging and calibration, thus providing a technique to trim the curvature of a voltage reference after the final packaging has occurred.

Note that in the embodiments discussed above, the resistors comprising R4B are diffused, and the other resistors are polysilicon. The poly resistors track across temperature, whereas the diffused R4B resistors have positive curvature that overcomes the normal negative effect of the band-gap curvature. This same technique may be advantageously applied to other resistors in the circuit as well. For example, sections of the core resistors R2A, R2B, and R2C could be LDD-type resistors. The positive curvatures could be adjusted to overcome the negative curvature of the band-gap. In this case, however, the switches for selecting the appropriate resistance values would probably need to be p-channel devices to overcome the higher gate voltages at this position in the circuit. The curvature correction could be performed entirely by R2A, for example, or a combination of the R2 resistors and R4B. This embodiment has advantages for low-voltage references in which the "lift" in $V_{REF}$ from R4B is undesirable.

Another solution to correct the negative band-gap curvature, while avoiding lift caused by R4B is to add negative curvature to R1V. The negative curvature in R1V actually adds positive curvature to the output, since the ratio of R2/R1V controls the output. Again, the disadvantage of this approach is that it requires a more complicated switching structure (complementary switches in this case). The key point is that the present invention provides trimmable curvature correction by using one or more non-linear resistors to generate curvature opposite to that of the normal band-gap curvature in the output.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. An apparatus for compensating a negative curvature error associated with a band-gap voltage reference, the apparatus comprising:

a nonlinear resistor having a resistance that is non-linear over temperature, incorporated into the voltage reference, wherein a temperature curvature characteristic of the nonlinear resistor compensates for the negative curvature error of the band-gap voltage reference.

2. The apparatus of claim 1, wherein the non-linear resistor is a diffused resistor.

3. The apparatus of claim 2, wherein the non-linear resistor is a diffused n-type lightly-doped drain (LDD) resistor.

4. The apparatus of claim 1, further comprising a network of non-linear resistors that are selectable via a non-volatile memory.

5. The apparatus of claim 4, wherein the non-linear resistor is outside of a band-gap core.

6. The apparatus of claim 1, wherein at least one resistor in a band-gap core is a non-linear resistor.

7. The apparatus of claim 4, wherein the non-volatile memory is an EEPROM.

8. The apparatus of claim 4, wherein the non-volatile memory is a set of polysilicon fuses.

9. The apparatus of claim 1, wherein the current through the nonlinear resistor is substantially constant over temperature.

10. A method for trimming a curvature error in a CMOS reference voltage circuit, the method comprising:

measuring an amount of curvature error present in an output reference voltage; and programming a non-volatile memory with an appropriate value to select a set of non-linear resistors from a plurality of non-linear resistors to trim the curvature error, wherein each resistor of the plurality of non-linear resistors is a non-linear resistor.

11. The method of claim 10, wherein a curvature characteristic of the non-linear resistors compensates for the curvature error of the reference voltage circuit.

12. The method of claim 11, wherein the non-linear resistors are diffused resistors.

13. The method of claim 12, wherein the diffused resistors are n-type lightly-doped drain (LDD) resistors.

14. The method of claim 10, wherein the selecting a set of non-linear resistors comprises switching resistors that set a voltage level at bases of transistors in a band-gap core.

15. The method of claim 10, wherein the measuring and programming are performed after the circuit has been packaged.

16. A CMOS voltage reference comprising:

a band-gap core; and at least one non-linear resistor, having a non-linear temperature curvature, connected to the band-gap core, wherein the curvature characteristic of the at least one non-linear resistor compensates for a negative curvature error in an output of the voltage reference.

17. The CMOS voltage reference of claim 16, wherein the at least one non-linear resistor comprises at least one diffused resistor.

18. The CMOS voltage reference of claim 17, wherein the at least one non-linear resistor comprises at least one lightly-doped drain (LDD) resistor.

19. The CMOS voltage reference of claim 16, further comprising a network of non-linear resistors that are selectable via a programmable non-volatile memory.

20. The CMOS voltage reference of claim 19, wherein the non-linear resistors are outside of the band-gap core and have a positive temperature curvature.

21. The CMOS voltage reference of claim 19, wherein at least one of the resistors in the band-gap core is a non-linear resistor.

22. The CMOS voltage reference of claim 21, wherein the at least one non-linear resistor in the band-gap core has a negative temperature curvature to compensate the negative curvature error in the output.

23. The CMOS voltage reference of claim 20, wherein the non-volatile memory is an EEPROM.

24. The CMOS voltage reference of claim 16, wherein the current through the at least one non-linear resistor is substantially constant over temperature.

25. The CMOS voltage reference of claim 23, further comprising:

a level select circuit.

26. The CMOS voltage reference of claim 25, wherein additional non-linear resistors are selected based on a voltage chosen by the level select circuit.

* * * * *